US005636606A

United States Patent [19]

Tsunoda et al.

[11] Patent Number: 5,636,606

[45] Date of Patent: Jun. 10, 1997

[54] CASING FOR A RECOIL STARTER

[75] Inventors: Shuhei Tsunoda, Misatomachi; Mitsuo Osakabe, Harunamachi; Keizo Shimizu, Annaka, all of Japan

[73] Assignee: Starting INdustrial Co., Ltd, Japan

[21] Appl. No.: 604,434

[22] Filed: Feb. 21, 1996

[30] Foreign Application Priority Data

Mar. 3, 1995 [JP] Japan ..... 7-070716

[51] Int. Cl.[6] ..... F02N 3/02

[52] U.S. Cl. ..... 123/185.3; 123/198 E

[58] Field of Search ..... 123/185.2, 185.3, 123/185.4, 198 E

[56] References Cited

U.S. PATENT DOCUMENTS 2,912,966 11/1959 Mitchell ..... 123/185.2

4,492,190 1/1985 Greenwood et al. ..... 123/185.2

FOREIGN PATENT DOCUMENTS 2-31576 8/1990 Japan .

*Primary Examiner*—Andrew M. Dolinar

*Attorney, Agent, or Firm*—Laurence R. Brown

[57] ABSTRACT

A recoil starter casing is made from a plate. The plate has a polygonal top face and a plurality of rectangular side faces integral with and extending from respective edges of the top face. Each of the side faces includes a recess in its edge, and a pair of projections at opposite ends of the recess. A plurality of air inlets are formed in the side faces. The side faces are bent from the top face along the respective edges of the top face. A fan cover has slots. The projections are inserted into the corresponding slots. The free ends of the projections are then bent so as to secure the starter casing to the fan cover. The inside of the starter casing is cooled through the air inlets and the recesses or air vents.

5 Claims, 4 Drawing Sheets

PRIOR ART

CASING FOR A RECOIL STARTER

BACKGROUND OF THE INVENTION

1. Field of the Invention

The present invention relates to a casing for a recoil starter adapted to start an internal combustion engine.

2. Description of the Prior Art

A conventional recoil starter is disclosed, for example, in Japanese utility model publication No. Hei 2-31576 published on Aug. 27, 1990. Referring specifically to FIG. 4(*a*), the reference numeral 1 denotes a starter casing within which a shaft 2 is fixed in position. A reel 3 is rotatably mounted to the shaft 2. The reel 3 has a circumferential groove 3*a* within which a rope 4 is wound under the return force of a spring 5.

A ratchet is mounted to the reel 3 and has a central fixed pin. The reel 3 has a ramp surface and a convexed surface adjacent to its circumferential edge. The ratchet is movable between the ramp surface and the convexed surface of the reel 3. A friction plate 9 is mounted to the shaft 2 and has a guide adapted to guide the pin so that the ratchet is moved in a radial direction.

A pulley 13 is connected to an engine and has a concaved end.

As shown in FIG. 4(*b*), a plurality of air inlets 15 are formed in the entire circumference of the starter casing 1 for cooling purposes. The starter casing i is secured to a fan cover by bolts 16.

With the conventional recoil starter, when the rope 4 is withdrawn against the return force of the spring 5, the reel 3 is rotated with the ratchet since the friction plate 9 is fixed due to frictional engagement with the shaft 2. The ratchet is moved between the ramp surface and the convexed surface while the ratchet pin is guided by the guide of the friction plate 9. The end of the ratchet is radially moved into engagement with the concaved end of the pulley 13. The pulley is then rotated to start the engine.

After the engine has been started, the rope 4 is released to cause the reel 3 to be rotated in an opposite direction under the return force of the spring 5. The rope 4 is then rewound around the reel 3. The ratchet is also returned to its initial position.

To manufacture such a conventional recoil starter, a circular plate is first subject to a drawing process once or twice to form a cap-like casing. The circumference of the casing is then machined or drilled (normally 20 to 40 times) to form a plurality of air inlets 15 in the circumference of the casing. If the circular plate is subject to a drawing process after the air inlets have been formed, the circumference of the casing, particularly a portion of the casing adjacent to the lower edges of the air inlets 15, is likely to be deformed, broken or torn to a substantial extent. This is because the starter casing can not be expanded or shrunk in a uniform fashion. To this end, the plate must be subject to a drawing process to form a cap-like casing before the air inlets 15 are formed in the circumference of the casing.

Such a known method involves a large number of fabrication steps and is thus cumbersome and expensive.

SUMMARY OF THE INVENTION

In view of the foregoing, it is an object of the present invention to provide a casing for a recoil starter which is simple and economical to manufacture.

In order to achieve the above object, the present invention provides a starter casing for a recoil starter. The recoil starter includes a fan cover, a reel rotatably mounted to the starter casing, and a rope wound around the reel under the return force of a spring and withdrawn so that the reel is rotated to start an internal combustion engine.

The starter casing includes a polygonal top face, and a plurality of side faces integral with and bent from the top face, the side faces each including a plurality of cooling air inlets.

Also, each of the side faces includes a recess in its outer edge, and a pair of projections formed at opposite ends of the recess. The fan cover has slots to receive the projections. The free ends of the projections are bent after the projections have been inserted into the fan cover through the slots.

According to another aspect of the present invention, there is provided a starter casing for a recoil starter which includes a fan cover, a reel rotatably mounted to the starter casing, and a rope wound around the reel under the return force of a spring and withdrawn so that the reel is rotated to start an internal combustion engine. The starter casing is made from a plate which is plated with a suitable anticorrosive material or made of stainless steel or aluminum-base alloy. The plate has a polygonal top face, and a plurality of side faces integral with and bent from the top face, the side faces each including a plurality of cooling air inlets.

A plurality of air inlets are punched from the rectangular side faces of the plate prior to fabrication. The side faces are then bent at substantially right angles or at a slightly obtuse angle from the top face, all in the same direction. The recoil starter casing can thus be fabricated in an easy process.

Also, each of the side faces includes a recess in its outer edge, and a pair of projections formed at opposite ends of the recess. The fan cover has slots to receive the projections. The free ends of the projections are bent after the projections have been inserted into the fan cover through the slots.

This increases the mechanical strength of the recoil starter casing and eliminates the use of bolts when the starter cover is secured to the fan cover.

BRIEF DESCRIPTION OF THE DRAWINGS

The present invention will now be described, by way of example, with reference to the accompanying drawings, in which:

FIG. 4(*a*) is a side view of the recoil starter, and FIG. 4(*b*) illustrates air inlets as seen in the direction of the arrow in FIG. 4(*a*).

DETAILED DESCRIPTION OF THE PREFERRED EMBODIMENTS

A first embodiment of the present invention will now be described with reference to FIGS. 1 and 2.

Figure 1:
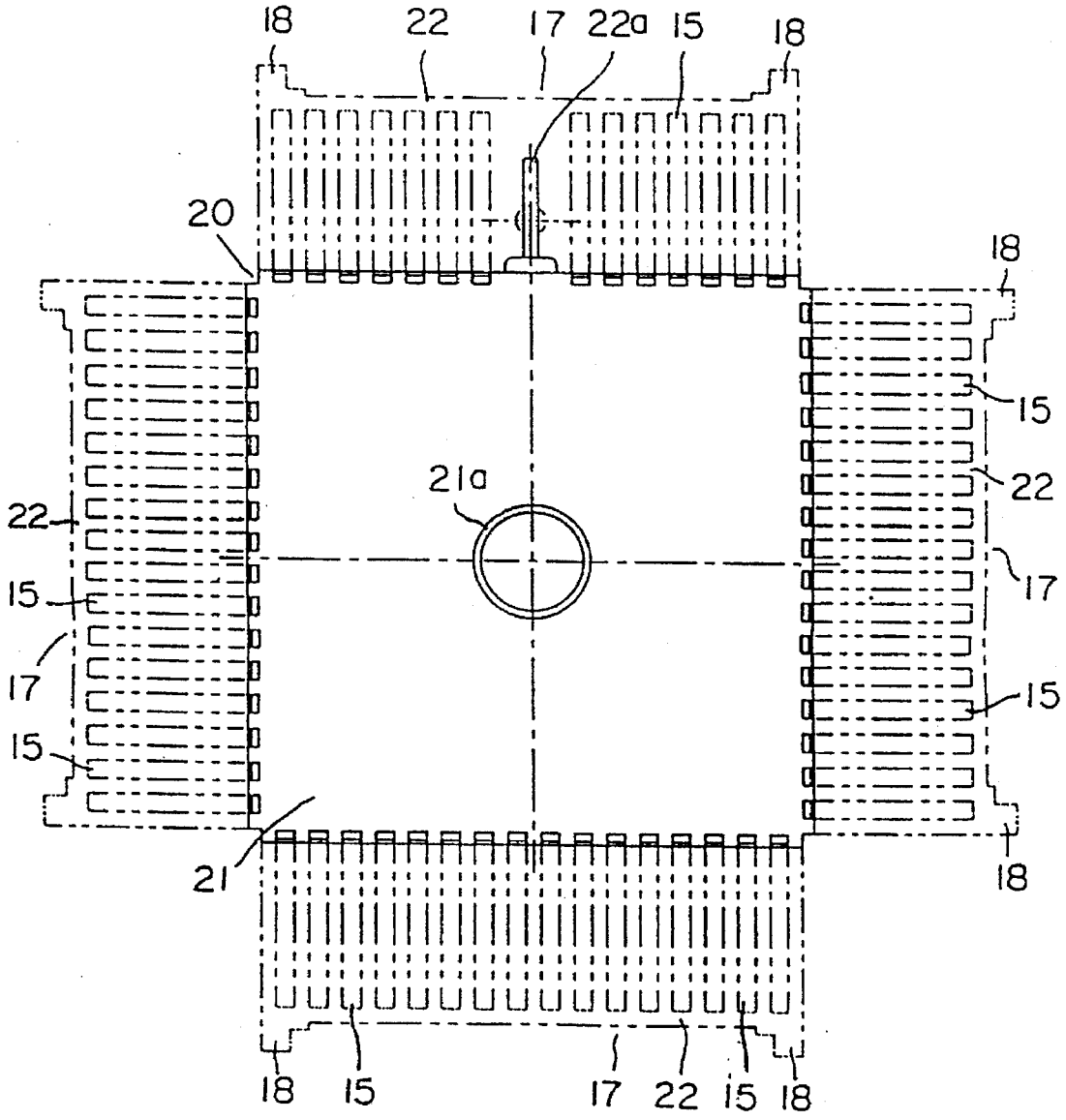
FIG. 1 is a front view of a starter casing made according to a first embodiment of the present invention.
Figure 2:
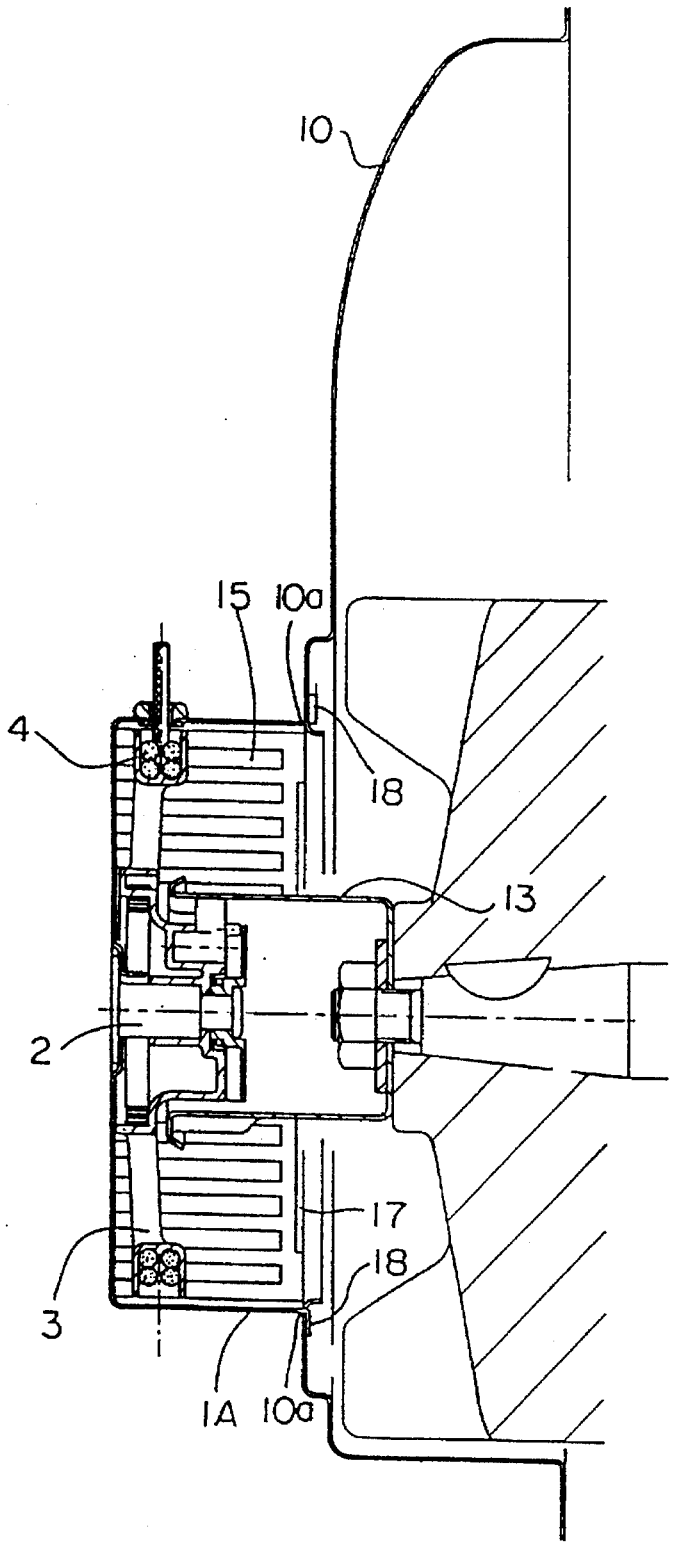
FIG. 2 is a side view of a recoil starter with the starter casing shown in FIG. 1.

FIG. 1 shows the structure of a starter casing made according to the first embodiment of the present invention. FIG. 2 shows the structure of a recoil starter with the starter casing shown in FIG. 1.

In this embodiment, a plate 20 is plated with a suitable anticorrosive material or made of stainless steel or aluminum-base alloy. As shown by broken lines in FIG. 1, the plate 20 has a square top face 21, and four substantially rectangular side faces 22 integral with and extending from the top face 21. A recess 17 is formed in the outer edge of each of the four side faces 22. A pair of projections 18, 18 are formed at opposite ends of the recess 17. A slit 22*a* is formed in one of the side faces 22 to allow for the passing of a rope 4. The top face 21 has a central opening 21*a* shaped to receive a shaft 2. A plurality of air inlets 15 are formed in each of the side faces 22 of the plate 20 by a punch or other tools. The air inlets 15 are arranged in parallel and extend into the top face 21.

The recesses 17 are punched from the plate simultaneously with the air inlets 15.

In this embodiment, the side faces 22 are bent at substantially right angles from the top face 21, all in the same direction. A fan cover 10 has a plurality of slots 10*a*. The projections 18 of the side faces 22 are inserted into the corresponding slots 10*a*. The free ends of the projections 18 are then bent so as to secure a starter casing 1A to the fan cover 10. Advantageously, each of the recesses 17 forms an air vent in the lower portion of the side face 22.

In the first embodiment, the air inlets 15 are arranged in parallel and extend from the side faces 22 and into the top faces 21. This arrangement enables the side faces 22 to be readily bent from the top face 22 without subjecting the air inlets to any stress.

Figure 4A:
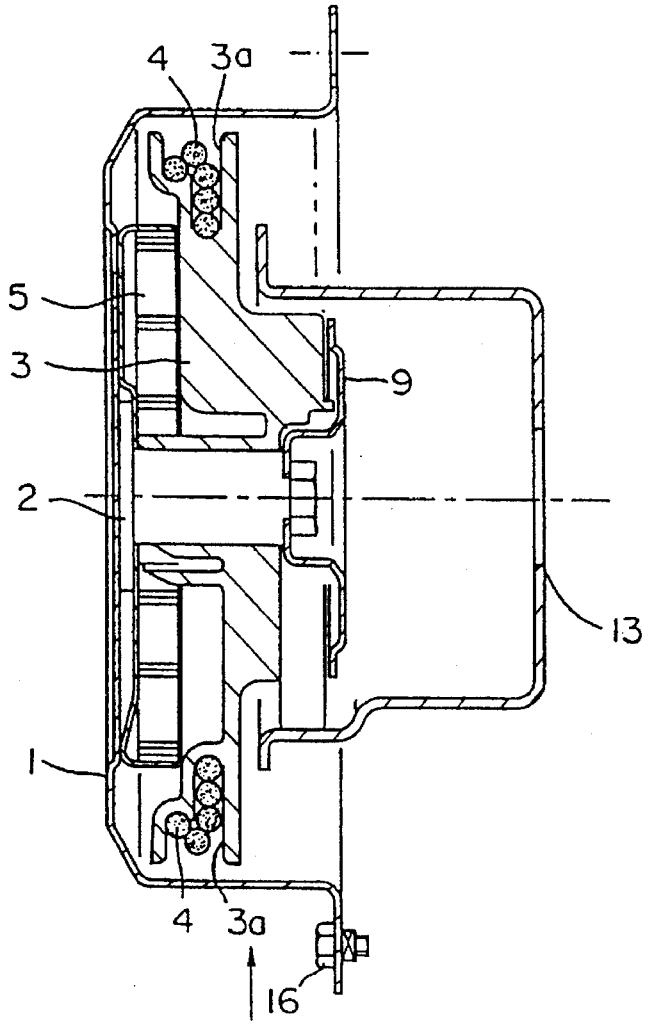
Fig. 4(a) PRIOR ART
FIG. 4 illustrates a conventional recoil starter.
Figure 4B:
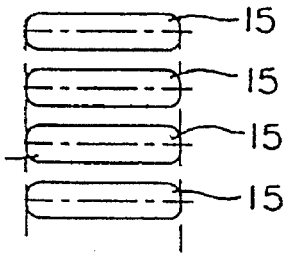

The internal structure and operation of the recoil starter are identical to those of the conventional recoil starter shown in FIG. 4 and will not be described herein.

To fabricate the casing, the side faces 22 are first bent from the square top face 21 of the plate 20 without subjecting the air inlets 15 to any stress. The projections 18 are then inserted into the slots 10*a* of the fan cover 10. The ends of the projections are thereafter bent so as to secure the starter casing 1A to the fan cover 10.

In this way, the starter casing 1A is attached to the fan cover without the need for bolts. The inside of the starter casing 1A is cooled not only through the air inlets 15, but also through the air vents which are formed in the lower ends of the side faces 22 by the recesses 17.

A second embodiment of the present invention will now be described with reference to FIG. 3.

Figure 3:
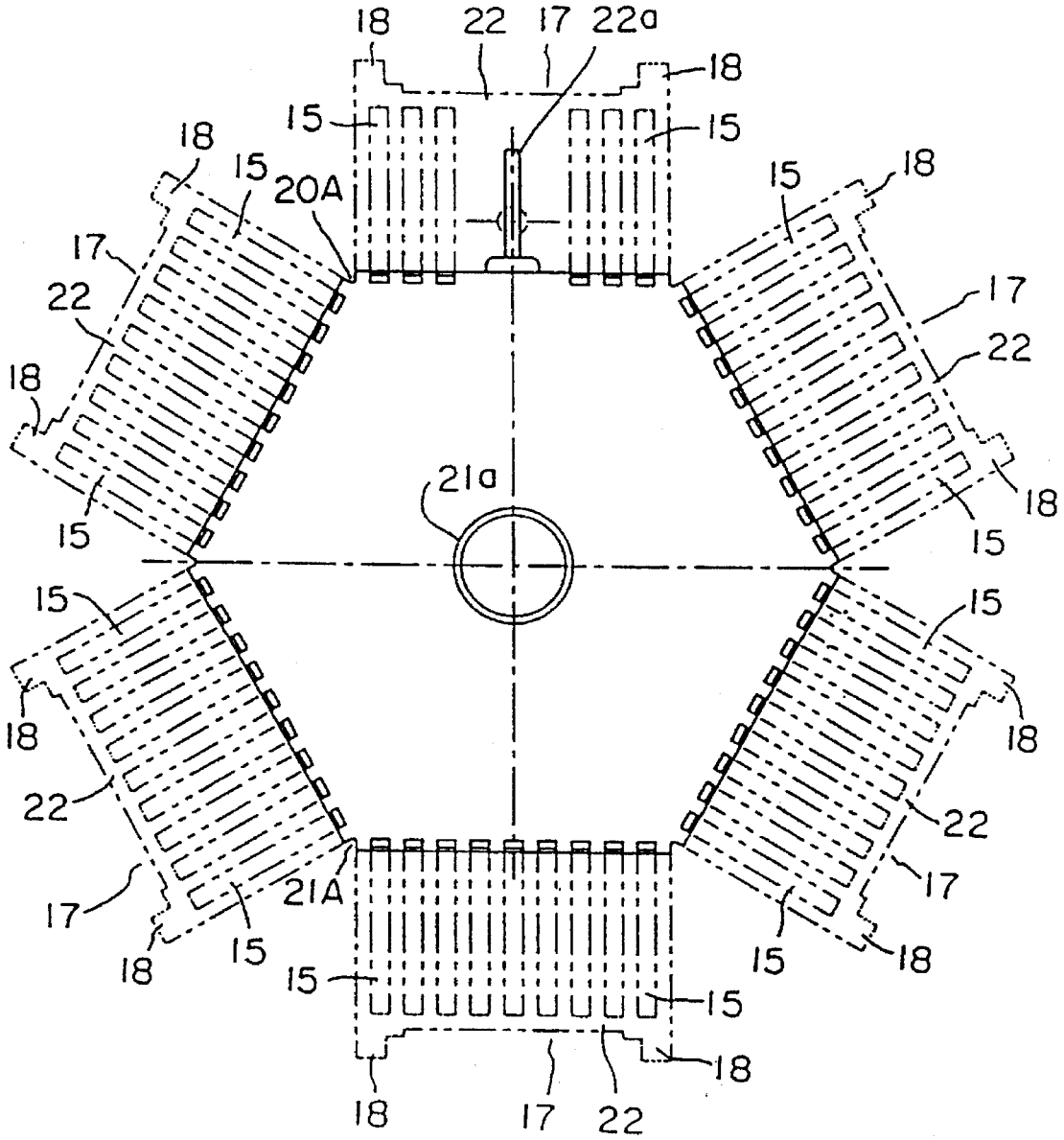
FIG. 3 is a front view of a starter casing made according to a second embodiment of the present invention.

FIG. 3 shows the structure of a starter casing made according to the second embodiment of the present invention.

In the second embodiment shown in FIG. 3, a plate 20A has a hexagonal top face 21A, and six side faces 22 integral with and extending from the top face 21A.

As in the first embodiment, the six side faces 22 of the plate 20A are easily bent at substantially right angles from the hexagonal top face 21A without subjecting the air inlets 15 to any stress. The projections 18 are inserted into the slots 10*a* of the fan cover 10. The free ends of the projections 18 are then bent so as to secure the starter casing to the fan cover 10.

The structure and operation of other parts of the second embodiments are identical to those of the first embodiment.

According to the present invention as thus far described, a starter casing is composed of a polygonal top face and a plurality of side faces integrally formed with the top face and including a plurality of air inlets. With this arrangement, the side faces are bent at substantially right angles from the top face along the ridges of the top face. In this way, the recoil starter casing can be fabricated at reduced cost.

Moreover, the side faces have recesses in their outer edges with a pair of projections at opposite ends of each recess. The projections are inserted into the slots of the fan cover. This arrangement increases the mechanical strength of the starter casing and eliminates the need of bolts when the starter casing is secured to the fan cover.

The present invention has been described with respect to its preferred embodiments. It will be understood that various modifications and changes may be made without departing from the spirit and scope of the invention as defined by the appended claims.

We claim:

1. A starter casing for a recoil starter, said recoil starter including a fan cover to which the starter casing is attached, a reel rotatably mounted to the starter casing, and a rope wound on the reel under the return force of a spring and withdrawn so that the reel is rotated to start an internal combustion engine, said starter casing comprising:

a flat plate with a polygonal area from which integrally extends a plurality of substantially rectangular faces with a plurality of air inlets therethrough bent to form a polygonal top face with said rectangular faces bent from the top face to form a plurality of side faces each including a plurality of cooling air inlets.

2. A starter casing according to claim 1, wherein the starter casing is made from an anticorrosive plate.

3. A starter casing according to claim 2, wherein said plate is plated or made of stainless steel or aluminum-base alloy.

4. A starter casing for a recoil starter, said recoil starter including a fan cover to which the starter casing is attached, a reel rotatably mounted to the starter casing, and a rope wound on the reel under the return force of a spring and withdrawn so that the reel is rotated to start an internal combustion engine, said starter casing comprising:

a polygonal top face; and a plurality of side faces integral with and bent from the top face, wherein each of the side faces includes a recess in an outer edge thereof, and a pair of projections formed at opposite ends of said recess and having free ends, and wherein said fan cover has slots, the free ends of the projections being bent after the projections are inserted into slots formed in a fan cover.

5. A starter casing for a recoil starter, said recoil starter including a fan cover to which the starter casing is attached, a reel rotatably mounted to the starter casing, and a rope wound on the reel under the return force of a spring and withdrawn so that the reel is rotated to start an internal combustion engine, said starter casing comprising:

a polygonal top face; and a plurality of side faces integral with and bent from the top face, said plurality of side faces each including a plurality of cooling air inlets, wherein each of the side faces includes a recess in an outer edge thereof, and a pair of projections formed at opposite ends of said recess and having free ends, and wherein said fan cover has slots, the free ends of the projections being bent after the projections are inserted into slots formed in a fan cover.

* * * * *